US008678640B2

(12) United States Patent
Yellen et al.

(10) Patent No.: US 8,678,640 B2
(45) **Date of Patent: *Mar. 25, 2014**

(54) MAGNETIC FLUID MANIPULATORS AND METHODS FOR THEIR USE

(71) Applicant: Drexel University, Philadelphia, PA (US)

(72) Inventors: Benjamin B. Yellen, Cary, NC (US); Gennady Friedman, Richboro, PA (US)

(73) Assignee: Drexel University, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/755,991

(22) Filed: Jan. 31, 2013

(65) Prior Publication Data

US 2013/0140241 A1 Jun. 6, 2013

Related U.S. Application Data

(63) Continuation of application No. 10/586,566, filed as application No. PCT/US2005/003236 on Jan. 28, 2005, now Pat. No. 8,398,295.

(60) Provisional application No. 60/540,092, filed on Jan. 28, 2004.

(51) Int. Cl.
*B01F 13/08* (2006.01)

(52) U.S. Cl.
USPC ..... 366/273; 435/302.1

(58) Field of Classification Search
USPC ..... 366/273, 274; 210/222, 223, 695; 435/302.1
See application file for complete search history.

(56) References Cited

U.S. PATENT DOCUMENTS

| | | | |
|---|---|---|---|
| 458,075 | A | 8/1891 | Shelton |
| 1,043,349 | A | 11/1912 | Ostwald |
| 3,219,318 | A | 11/1965 | Hershler |
| 3,439,899 | A | 4/1969 | Hershler |
| 3,892,908 | A | 7/1975 | Lovness |
| 3,987,967 | A | 10/1976 | Kuznetsov et al. |
| 4,085,037 | A | 4/1978 | Quets et al. |
| 4,310,253 | A | 1/1982 | Sada et al. |
| 4,720,025 | A | 1/1988 | Tatevosian et al. |
| 4,808,079 | A | 2/1989 | Crowley et al. |
| 5,200,084 | A | 4/1993 | Liberti et al. |
| 5,514,340 | A | 5/1996 | Lansdorp et al. |
| 5,626,764 | A | 5/1997 | Burns et al. |
| 5,985,153 | A | 11/1999 | Dolan et al. |
| 5,989,435 | A | 11/1999 | Herman et al. |

(Continued)

OTHER PUBLICATIONS

Greivell et al., "The Design of a Ferrofluid Magnetic Pipette", 1997, IEEE Transactions on Biomedical Engineering 44(3):129-135.

(Continued)

*Primary Examiner* — David Sorkin
(74) *Attorney, Agent, or Firm* — Saul Ewing LLP; Kathryn Doyle

(57) ABSTRACT

Device and methods for use of these devices to manipulate substantially non-magnetic particles dispersed inside a magnetic fluid by employing a changeable pattern of local magnetic field maxima and minima are provided.

19 Claims, 2 Drawing Sheets

(56) References Cited

U.S. PATENT DOCUMENTS

| | | | | |
|---|---|---|---|---|
| 6,033,574 | A | 3/2000 | Siddiqi | |
| 6,085,599 | A | 7/2000 | Feller | |
| 6,133,037 | A | 10/2000 | Tajimi | |
| 6,231,760 | B1 | 5/2001 | Siddiqi | |
| 6,287,463 | B1 | 9/2001 | Ohkawa | |
| 6,408,884 | B1 | 6/2002 | Kamholtz et al. | |
| 6,415,821 | B2 | 7/2002 | Kamholtz et al. | |
| 6,623,983 | B1 | 9/2003 | Terstappen et al. | |
| 6,660,159 | B1 | 12/2003 | Terstappen et al. | |
| 6,726,844 | B2 | 4/2004 | Ohkawa et al. | |
| 6,736,978 | B1 | 5/2004 | Porter et al. | |
| 6,764,859 | B1 | 7/2004 | Kreuwel et al. | |
| 8,398,295 | B2 * | 3/2013 | Yellen et al. | 366/273 |
| 2002/0022276 | A1 | 2/2002 | Zhou et al. | |
| 2002/0036141 | A1 | 3/2002 | Gascoyne et al. | |
| 2002/0117451 | A1 | 8/2002 | Foy et al. | |
| 2002/0166760 | A1 | 11/2002 | Prentiss et al. | |
| 2003/0022370 | A1 | 1/2003 | Casagrande et al. | |
| 2004/0009614 | A1 | 1/2004 | Ahn et al. | |
| 2004/0018611 | A1 | 1/2004 | Ward et al. | |
| 2005/0221339 | A1 | 10/2005 | Griffiths et al. | |
| 2005/0266433 | A1 | 12/2005 | Kapur et al. | |
| 2006/0020371 | A1 | 1/2006 | Ham et al. | |
| 2006/0133954 | A1 | 6/2006 | Schroeder et al. | |
| 2008/0302732 | A1 | 12/2008 | Soh et al. | |

OTHER PUBLICATIONS

Hovorka et al., "Modeling Stability of Trapped Ferromagnetic Nanoparticle Chains", 2003, IEEE Transactions on Magnetics 39(5):2549-2551.

Ozin et al., "The Race for the Photonic Chip: Colloidal Crystal Assembly in Silicon Wafers", 2001, Adv. Funct. Mater. 11(2):95-104.

Plaks et al., "Generalized Finite-Element Method for Magnetized Nanoparticles", 2003, IEEE Transactions on Magnetics 39(3):1436-1439.

Xia at al., "Template-Assisted Self-Assembly of Spherical Colloids into Complex and Controllable Structures", 2003, Adv.Funct. Mater. 13(12):907-918.

Yellen et al., "Printing superparamagnetic colloidal particle arrays on patterned magnetic film", 2003, J. Applied Physics 93(10):7331-7333.

Yellen et al., "Programmable Assembly of Colloidal Particles Using Magnetic Microwell Templates", 2004, Langmuir 20:2553-2559.

Yellen et al., "Programmable Assembly of Heterogeneous Colloidal Particle Arrays", 2004, Adv. Mater. 16(2): 111-115.

Yellen et al., "Analysis of interactions for magnetic particles assembling on magnetic templates", 2002 , J. Applied Physics 91(10):8552-8554.

Yellen et al., "Analysis of repulsive interactions in chains of superparamagnetic colloidal particles for magnetic template-based self-assembly", 2003, J. Applied Physics 93(10):8447-8449.

* cited by examiner

MAGNETIC FLUID MANIPULATORS AND METHODS FOR THEIR USE

CROSS-REFERENCE TO RELATED APPLICATIONS

This application is a continuation of U.S. patent application Ser. No. 10/586,566, filed Mar. 27, 2007, now U.S. Pat. No. 8,398,285, which is a U.S. national phase application filed under 35 U.S.C. §371 claiming benefit to International Patent Application No. PCT/US05/003236, filed Jan. 28, 2005, which claims priority under 35 U.S.C. 119(e) to U.S. Provisional Patent Application No. 60/540,092, filed Jan. 28, 2004, all of which are herein incorporated by reference in their entirety.

STATEMENT REGARDING FEDERALLY SPONSORED RESEARCH OR DEVELOPMENT

This invention was made with government support under NIRT award number ECS-0304453 awarded by the National Science Foundation. The Government therefore has certain rights in this invention.

INTRODUCTION

1. Field of the Invention

The present invention relates to devices and methods for use of these devices in manipulating substantially non-magnetic particles including, but in no way limited to, molecules, living cells, and other matter dispersed in a fluid also inclusive of magnetic particles by employing a changeable pattern of local magnetic field maxima and minima. In the devices of the present invention, magnetic particles in the fluid are attracted to selected areas of a surface of a substrate or chamber in which the fluid is held by magnetic field gradients produced by a pattern of magnetic features embedded in or held in close proximity to the surface. Upon application of external, time varying magnetic fields, the magnetic particles apply a body force on the fluid and non-magnetic particles in the fluid as well. Thus, these devices are useful in methods of mixing and/or directing movement of non-magnetic particles on the surface of the fluid holding chamber or substrate. These devices and methods are particularly useful in fields that require efficient mixing near surface interfaces on a microscopic scale, such as in biosensing and materials synthesis. These devices also serve as parallel micro-tweezers for stretching non-magnetic particles attached to surfaces and manipulating suspended non-magnetic particles in the vicinity of the surface. In addition, the magnetic features patterned on the surface of the fluid holding chamber or substrate can be programmed to arrange the non-magnetic particles into a selected geometric configuration on the surface.

2. Background of the Invention

The ability to control the motion of colloidal objects and other matter dispersed inside fluids has a wide range of applications in sensing, biomaterial synthesis, microfluidics, lab-on-a-chip, photonics, electronics assembly, genome analysis, and assembling cellular systems. One of the main limitations in biosensor applications, for example, is the inherent difficulty in efficiently bringing target molecules into proximal contact with the sensor regions on the surface. Current mixing techniques are effective in moving fluids in the bulk but much less effective in moving fluids near surface interfaces. The relative slow motion of fluids near surfaces contributes to the inability for molecules, colloidal objects, and cells to easily diffuse towards surfaces. This effect substantially decreases the probability for these objects to interact with surfaces. In the case of biosensors, this problem reduces the sensitivity of the biosensor since the time required for target molecules to reach a sensor region is greatly increased. In the case of surface conjugation and material synthesis, the ineffective diffusion of molecules towards surface interfaces greatly increases the time for chemical reactions to take place on surfaces.

The ability to move fluid near surfaces has additional applications, such as in stretching and perturbing objects attached to surfaces and arranging colloidal objects into precise geometric patterns on a substrate surface.

Surfaces containing an array of colloidal objects have been fabricated in the past for applications in photonic crystals, and magnetic and electric sensors. Self-assembly techniques for arranging colloidal patterns by hydrodynamic currents and by surface tension forces have been successful for arranging identical components on surfaces (Ozin et al. Adv. Func. Mater. 2001 11:95, Xia et al. Adv. Func. Mater. 2003 13:907). Most traditional self-assembly techniques, however, fall short when it comes to assembling multi-component ordered patterns. Manipulating fluids and building multi-component surfaces on micrometer and nanometer length scales remains a major challenge.

While significant time and resources have been invested in the area of mixing, pumping, and creating multi-component surfaces, no single technique has been developed to date that can efficiently program the movement of fluids near surfaces simultaneously over large areas on a microscopic scale.

U.S. Pat. No. 6,415,821 and U.S. Pat. No. 6,408,884, disclose a method for moving bulk fluid through channels using slugs of ferrofluid that are designed to be immiscible with the fluid of interest (Greivell, et al., 1997, IEEE Trans. Biomed. Eng. 44:129).

U.S. Pat. No. 4,808,079 discloses a pump for ferrofluid, again designed to produce bulk fluid motion.

In addition, micron-sized magnetic particles that are physically attached to various molecules, such as proteins, DNA fragments or fluorescent labels, have been arranged into programmable geometric patterns using magnetic forces and magnetically encoded surfaces (Yellen et al. J. Appl. Phys. 2003 93:7331; Yellen et al. Langmuir 2004 20:2553; Yellen et al. Adv. Mat. 2004 16:111). Previous work has shown that the number of particles deposited (or not deposited) at each array lattice site can be reliably controlled through a combination of magnetic and morphological template features. Regular heterogeneous colloidal patterns were assembled by this technique using only physical forces (i.e. magnetic, macroscopic hydrodynamic and surface forces). The theoretical process of particle assembly onto magnetic surfaces has also been analyzed previously in order to guide experimental investigations (Yellen et al. 2002 J. Appl. Phys. 912:855; Yellen et al. J. Appl. Phys. 2003 93:8447; Plaks et al. IEEE Trans. Mag. 2003 39:1436; and Hovorka et al. IEEE Trans Mag. 2003 39:2549).

In the present invention devices are provided for mixing and manipulating non-magnetic particles, not by attachment to a magnetic particle, but rather by suspension in a fluid containing magnetic particles. Control of the motions of non-magnetic particles in the devices of the present invention is accomplished using an effective diamagnetic force that can be applied on non-magnetic particles in a fluid also containing magnetic particles. The substantial magnetization acquired by a fluid comprising a large volume fraction of magnetic particles transmits this force to any non-magnetic or low magnetically susceptible particles suspended in the same fluid. Magnetization on the fluid is controlled on a micron scale with at least two magnetic field sources positioned in close proximity to, or inside of the chamber holding the fluid. These magnetic field sources allow for non-magnetic particles suspended in the fluid to be locally manipulated near surfaces in which the fluid is in contact with in a highly controllable fashion.

Using these devices, magnetic particles can be circulated around selected substrate sites in order to manipulate the surrounding fluid and non-magnetic particles including, but not limited to, molecules, proteins, colloidal objects and cells, contained within the fluid. These devices are useful in increasing the sensitivity of biosensors, in decreasing reaction times at surface interfaces by more efficiently bringing chemical reagents to surface interfaces, in perturbing, stretching and dislodging molecules and objects attached to surfaces, and in providing a method for sorting or arranging one or more different types of components into pre-programmed arrangements.

SUMMARY OF THE INVENTION

An object of the present invention is to provide a device for manipulating substantially non-magnetic particles suspended in a fluid also comprising magnetic particles. The device comprises the fluid containing a dispersion of magnetic particles and a dispersion of non-magnetic particles, a chamber, also referred to herein as a substrate for holding or containing the fluid, and at least two sources of magnetic fields positioned in close proximity to, or inside of, the fluid holding chamber. The magnetic field sources produce a changeable pattern of magnetic field minima and maxima regions thereby causing the non-magnetic particles in the fluid to be transported towards the magnetic field minima regions by magnetic force.

Another object of the present invention is to provide methods for mixing, transporting, sorting and/or arranging non-magnetic particles in the vicinity of a surface of a fluid holding chamber using the device of the present invention. In these methods, the trajectories of non-magnetic particles in the fluid are controlled through creation of traveling magnetic field maxima and minima regions on or near the inner surface of the fluid holding chamber affected through the presence of patterned magnetic features.

In one embodiment, the device is used to locally perturb selected non-magnetic particles attached to the inner surface of the fluid holding chamber in order to provide a way to selectively dislodge particles attached to specific locations on the surface.

In another embodiment, the device is used to transport non-magnetic particles in the fluid.

In another embodiment, the device is used to sort and/or assemble different patterns of particles on the inner surface of the substrate or fluid holding chamber. This can be accomplished by controlling the magnetization of magnetic features patterned on the substrate or fluid holding chamber. Non-magnetic particles in the fluid can be simultaneously pushed in programmed directions and ultimately sorted or assembled into unique configurations according to the magnetization of the substrate and movement of the magnetic particles in the fluid. The magnetic features on the substrate can then be re-magnetized and a new set of non-magnetic particles can be added to the fluid for sorting or arranging into a unique ensemble according to the newly programmed state of the magnetic features of the substrate. By repeating this procedure with various non-magnetic particles, multi-component objects can be sorted and assembled into unique figurations step by step.

DETAILED DESCRIPTION OF THE INVENTION

Figure 1:
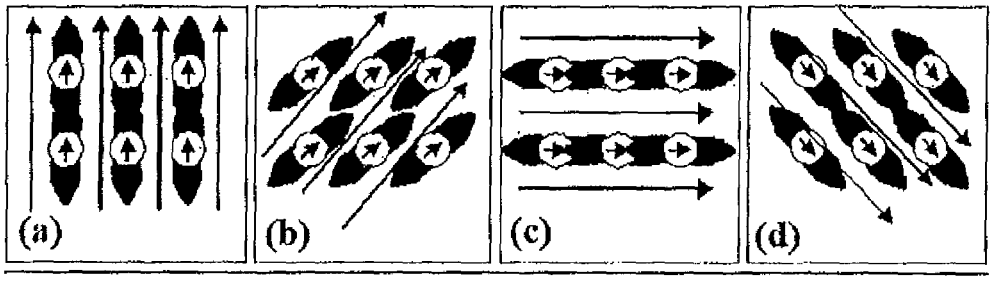
FIG. 1 is an illustration depicting the top view of a substrate patterned with circular magnetic features. An external magnetic field is rotated with its axis of field rotation aligned normal to the plane, and the series of images (a-d) depict the ferrofluid movements on the substrate depending on the external field applied. The externally applied fields are strong enough to continually re-magnetize the magnetic features with the rotating external field resulting in smooth movement of ferrofluid around the magnetic features in pursuit of the traveling regions of magnetic field maxima.

The present invention provides devices and methods for use of devices that utilize a fluid comprising a dispersion of magnetic particles to manipulate non-magnetic particles affected through a changeable pattern of magnetic filed maxima and minima.

In simplest form, the device comprises a fluid holding chamber or substrate capable of containing a fluid, a fluid containing a dispersion of non-magnetic particles and a dispersion of magnetic particles, and at least two sources of magnetic fields positioned in close proximity to, or inside of, the fluid holding chamber or substrate. The magnetic field sources must be capable of producing a changeable pattern of magnetic field minima and maxima regions thereby causing the non-magnetic particles in the fluid to be transported towards the magnetic field minima regions by magnetic force. As shown herein, depending on the orientation of the external magnetic fields applied to the substrate, magnetic particles of the fluid will assemble at different locations with respect to each magnetic feature contained inside, patterned on top of, or held in the vicinity of the fluid holding chamber or substrate. By varying the magnetic fields in time, force can be applied to the non-magnetic particles in the fluid through the presence of the magnetic particles suspended in the same fluid.

In one embodiment, the substrate or fluid holding chamber itself contains magnetic features used in combination with one or more external magnetic field sources to manipulate the non-magnetic particles on a local scale.

In this embodiment, a spatially uniform rotating magnetic field can be applied to the fluid holding chamber or substrate of the device with the axis of rotation aligned normal to the substrate. This system causes magnetic particles of the fluid to circulate around the magnetic features of the substrate in pursuit of the magnetic field maxima traveling around the edges of the magnetic features while non-magnetic particles are caused to assemble on top of the magnetic features in pursuit of a constant region of magnetic field minima. The created fluid currents caused by the movement of the magnetic particles are fastest near surface interfaces, and this serves the dual functions of mixing the fluid as well as producing lift forces to attract the non-magnetic particles on top of the magnetic features while sweeping away other regions of the surface.

Alternatively, a spatially uniform rotating magnetic field can be applied with its axis of rotation aligned parallel to the substrate or fluid holding chamber and orthogonal to the magnetization of the magnetic features patterned on the substrate or fluid holding chamber. This configuration causes magnetic particles to move linearly across the substrate in a constant direction, with the speed of motion dependent on the strength of the external field and the frequency of the field rotation. The type of fluid convection produced in this embodiment is useful in transporting non-magnetic particles, such as molecules, colloids, and cells, along desired directions on a substrate or fluid holding chamber surface for the purpose of continuously exposing the surface to new particles. This type of fluid convection is also useful in locally perturbing particles attached to a surface of the substrate or fluid holding chamber in any conceivable direction, in order to stretch particles attached to the surface or break electrical interconnections between devices that have assembled on substrates.

In another embodiment, the magnetic features patterned on the substrate or fluid holding chamber are magnetized individually and programmed to manipulate the non-magnetic particles suspended in the fluid and assemble them into precise geometric arrangements. A purpose of this embodiment is to provide a means for sorting identical non-magnetic particles suspended in the fluid and assembling them into useful devices.

In another embodiment, the magnetic features patterned on the substrate or fluid holding chamber are re-programmed after a first set of non-magnetic particles have been sorted and/or assembled, and a second set of non-magnetic particles placed on the substrate are sorted and/or assembled into a different geometrical pattern without significantly altering the first previously assembled particles. Multi-component surfaces can be assembled after many such steps, wherein each step a new set of non-magnetic particles is assembled. Thus, in some embodiment of the present invention, the device further comprises an array of different non-magnetic particles attached to the inner surface of the fluid holding chamber. In this embodiment, the array of attached non-magnetic particles preferably comprises nanoparticles or microparticles attached to the inner surface of the fluid holding chamber.

In the device of the present invention, magnetic particles, preferably nanometer in size and referred to herein as magnetic nanoparticles, are exposed to the substrate or inner surface of the fluid holding chamber as a dispersion or suspension in a carrier fluid. The magnetic particles dispersed in the fluid may comprise magnetic nanoparticles, paramagnetic ions, and/or molecular magnets. Thus, the magnetic particles can range from single magnetic ions (less than 1 nm in diameter) to magnetic grains that are hundreds of nanometers in diameter, more preferably from about 5 to about 30 nanometers. The magnetic particles may comprise iron, iron-oxide, iron-platinum, cobalt, nickel, a rare-earth metal or another alloy forming ferromagnetic, or a ferrimagnetic or superparamagnetic material, or any combination thereof, suspended in a solvent. Examples of solvents for fluids used in the devices and methods of the present invention include, but are not limited to, water, alcohol, and organic based-solvents. In some embodiments, the magnetic nanoparticles have a surface covered by molecules which provide steric or ionic hinderance in order to prevent irreversible aggregation of the magnetic nanoparticles in the fluid. An exemplary suspension of magnetic particles useful in the present invention is a ferrofluid which comprises a suspension of ultrafine iron oxide nanoparticles. Magnetic nanoparticle suspensions such as ferrofluid provide a desirable alternative to micron-sized and sub-micron sized polymerized beads loaded with magnetic grains (such as those produced by Dynal Biotech or Spherotech) because ferrofluid nanoparticles do not settle out of solution by gravitational forces or stick to surfaces by surface forces as micron-sized particles are prone to do. Suspensions such as highly stabilized ferrofluid are preferred for fast programmable movement around substrates. Further, the motions achieved with highly stabilized ferrofluid near the substrate are accomplished with the highest resolution.

The fluid further comprises a dispersion of non-magnetic particles or substantially non-magnetic particles. By non-magnetic particles or substantially non-magnetic particles it is meant any molecule or group of molecules not attracted to the magnetic field maxima of a magnetic feature but rather attracted to the magnetic field minima of a magnetic feature. Examples include, but are in no way limited to nucleic acids such as DNA, RNA, and combinations thereof, proteins and peptides, small organic and inorganic molecules and cells. Preferably the non-magnetic particles are nanoparticles or microparticles.

The device further comprises at least two sources of magnetic fields responsible for directing movement and assembly of the suspended magnetic and non-magnetic particles.

Preferably one of the sources comprises magnetic features with dimensions ranging in size from 0.1 nm to 10,000 nm, more preferably 10 to 1000 nanometers. These magnetic features may comprise iron, iron-oxide, iron-platinum, cobalt, nickel, a rare-earth metal or another alloy forming ferromagnetic, or a ferrimagnetic or superparamagnetic material, or any combination thereof. The magnetic features can be identical, forming a uniform array on the inner surface of the fluid holding chamber or substrate. Alternatively, the magnetic features can be patterned heterogeneously on the surface. The magnetic features can be patterned directly on the top of the substrate surface or inner surface of the fluid holding chamber; they can be embedded inside the surface of the substrate of fluid holding chamber; or they can be held external to but in the near vicinity of the substrate surface or inner surface of the fluid holding chamber.

An exemplary magnetic feature useful in the present invention is a magnetic bit pattern, which comprises thin magnetic film patterned directly on a substrate, such as silicon or silicon dioxide.

In an alternative embodiment, the magnetizable features are attached to mobile supports that are submerged in the fluid.

Preferably the second magnetic field source comprises a substantially uniform, time varying magnetic field supplied by a source held external to the surface of the substrate or fluid holding chamber. Examples of such sources include rotating permanent bar magnets, such as those used routinely in magnetic stirring hotplates, and solenoid cells with iron cores that are energized with a time-varying electrical current to produce time-varying magnetic fields, such as oscillating or rotating magnetic fields that permeate the substrate and the fluid. By "substantially uniform" it is meant that the time-varying fields have only weak magnetic field gradients, and thus only insubstantial forces are applied on the particles suspended in the fluid by the external magnetic field sources. This is also achieved using sources of magnetic fields which comprise an array of conductors and a means for switching or varying electrical current in the conductors.

In contrast to prior methods, such as U.S. Pat. No. 6,415,821 and U.S. Pat. No. 6,408,884, wherein the goal is to move bulk fluid through channels using slugs of ferrofluid that are designed to be immiscible with the fluid of interest (Greivell, et al., 1997, IEEE Trans. Biomed. Eng. 44:129), a goal in the present invention is to move fluid fastest near surfaces rather than the bulk fluid. Further, in the present invention the magnetic particles are miscible with the fluid and the non-magnetic particles are suspended within the same fluid.

The present invention also differs from U.S. Pat. No. 4,808,079, which discloses a pump for a ferrofluid, as the intent in the present invention is to manipulate and move non-magnetic materials within a magnetic fluid primarily by magnetic force as opposed to hydrodynamic force. Such movement is accomplished in the present invention by applying a changeable pattern of magnetic field that contains both local magnetic field maxima and minima. The magnetic field minima regions serve as traps for the non-magnetic particles, and these minima regions can travel across a surface by application of appropriate magnetic field configurations. Local magnetic field minima regions are not required in U.S. Pat. No. 4,808,079.

In some embodiments, depending upon the intended end use, the device of the present invention may further comprise a sensor attached to the inner surface of the fluid holding chamber. Examples of sensors for use in the present invention include, but are not limited to optical, electrical, electrochemical, and magnetic sensors.

Figure 2:
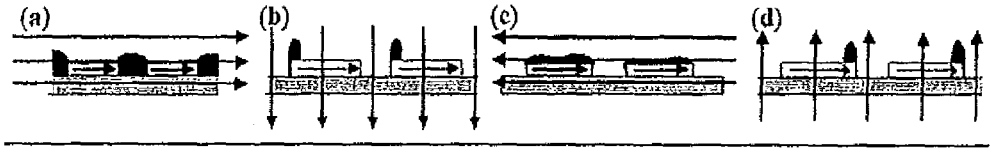
FIG. 2 is an illustration depicting the cross-sectional image of the substrate and its interaction with ferrofluid in the presence of a rotating external magnetic field with the axis of the field rotation aligned parallel to the substrate and orthogonal to the direction of magnetization in the magnetic features. In this illustration, ferrofluid (black) is initially attracted in between adjacent magnetic features by magnetic fields aligned parallel to the magnetization of the feature, as shown in (a). After rotating the fields 90°, the ferrofluid that previously accumulated in between adjacent magnetic features now collects at one end of the magnetic features, as shown in (b). After another 90° rotation, the ferrofluid accumulates on top of the magnetic features due to the presence of an external magnetic field aligned opposite to the magnetization of the features, as shown in (c). After another 90° rotation, the ferrofluid now moves to the opposite end of the magnetic features, as shown in (d), and this forward progression continues across one array period distance with each revolution of external magnetic field.

A diagram of the general process of field-assisted magnetic particle manipulation on a recordable magnetically patterned substrate in accordance with the present invention is shown in FIG. 1 through FIG. 5. As shown therein a substrate capable of containing a fluid is patterned with magnetic features. This substrate and the fluid contained therein with its dispersion of magnetic particles and a dispersion of non-magnetic particles is then subjected to substantially uniform, time-varying external magnetic field produced by a magnetic source held external to the substrate. In some cases, the time-varying external magnetic field continuously and simultaneously magnetizes the magnetic particles of the fluid and the magnetic features of the substrate, which preferentially push the magnetic particles in specific trajectories around the poles of the magnetic features of the substrate in pursuit of the traveling regions of magnetic field maxima. Meanwhile, the non-magnetic particles of the fluid are moved to opposite areas of the substrate surface in pursuit of the regions of magnetic field minima. The manipulation of non-magnetic particles is achieved primarily by the effective diamagnetic force induced on the non-magnetic particles caused by the fluid acquiring a net magnetization due to the presence of a substantial volume fraction of magnetic particles. For example, as shown in FIGS. 1(*a*), 1(*b*), 1(*c*), and 1(*d*), when the external magnetic field is rotating with its axis of field rotation aligned normal to the plane, magnetic particles circulate around the magnetic features of the substrate where the magnetic field is maximized, while non-magnetic particles are drawn to assemble on top of the magnetic features where the magnetic field is minimized. In another embodiment, the time-varying magnetic field magnetizes only the magnetic particles, while the magnetic features on the substrate have permanent magnetization. The result is that when an appropriately oriented rotating magnetic field is applied to the device, the magnetic particles are moved from one magnetic feature to the next following the regions of magnetic field maxima, as shown in FIGS. 2(*a*), 2(*b*), 2(*c*), and 2(*d*). To achieve this motion, the external magnetic field must be rotated with its axis of field rotation aligned parallel to the substrate and orthogonal to the permanent magnetization of the magnetic features. A traveling wave is set-up by this configuration, causing both the magnetic and non-magnetic particles to be moved in the same direction across the substrate. The difference is that the magnetic particles follow the regions of magnetic field maxima whereas the non-magnetic particles follow the regions of magnetic field minima. The motions of the magnetic particles along the substrate, either in linear or circular motions in the plane, is used to manipulate the fluid and transport, sort or arrange non-magnetic particles into desired configurations.

Figure 3:
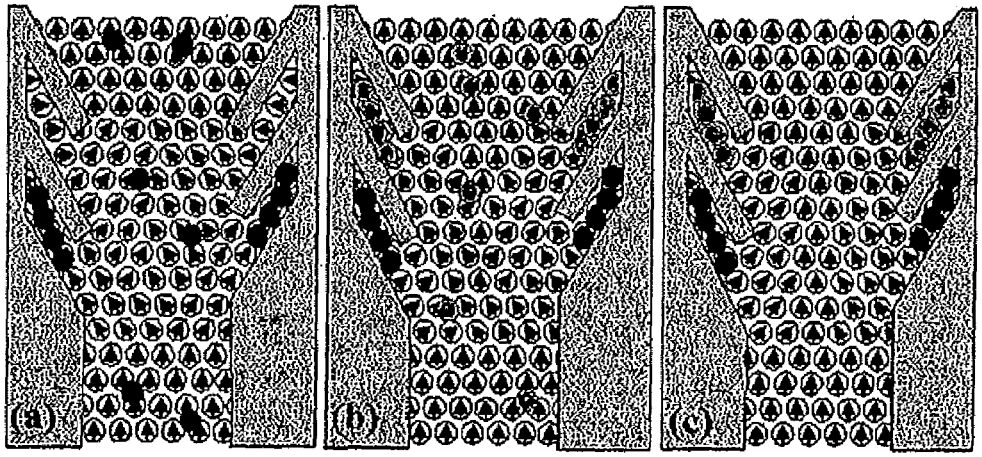
FIG. 3 is an illustration depicting how ferrofluid's movements can be programmed into a substrate containing an array of magnetic features, and how those movements can be used to push different sets of non-magnetic particles into precise geometric arrangements when combined with mechanical template structures. In this configuration, the external magnetic field is rotating, with the axis of field rotation aligned parallel to the substrate, thereby causing the magnetic and non-magnetic particles to move linearly across the substrate in pursuit of the regions of magnetic field maxima and minima, respectively, traveling across the substrate. This is accomplished by first magnetizing the magnetic features in appropriate directions in (a), with directions denoted by arrows, in order to push fluid and non-magnetic particles either into or out of certain mechanical template structures. This configuration is used to assemble a first set of non-magnetic particles (shown as black circles) into only certain channels of the mechanical template. Afterwards, the remaining non-magnetic particles are rinsed away, and the array of magnetic features is re-magnetized to direct a new set of non-magnetic particles into a different geometric pattern (shown as grey circles). After the second pattern has been assembled, the array of magnetic features is re-magnetized to push all remaining nonmagnetic particles, leaving a two component pattern.

FIGS. 3(*a*), 3(*b*), and 3(*c*) are diagrams depicting how the programmed motion of particles on a surface of a substrate can be used to sort or arrange several different sets of non-magnetic particles into precise geometric configurations. FIG. 3(*a*) depicts the substrate containing an array of magnetic features, which are programmed to assemble non-magnetic particles into a first geometric pattern. FIG. 3(*b*) depicts this same substrate after assembly of a first set of particles, followed by alignment and re-magnetization of the magnetic features contained on the substrate in order to push or direct a second set of non-magnetic particles into a different geometric arrangement. FIG. 3(*c*) depicts the array after two such assembly steps of two different sets of non-magnetic particles. This illustration demonstrates multiple utilities of the devices of the present invention, including transportation, sorting, and arranging non-magnetic particles.

Figure 4:
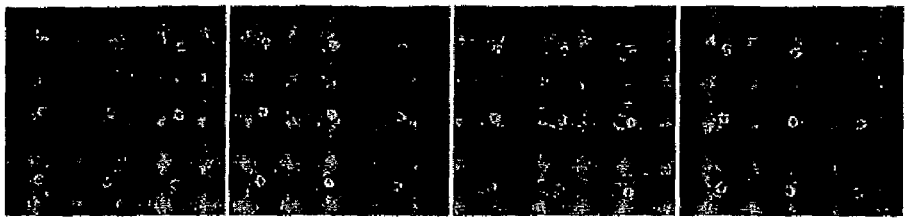
FIG. 4 is a sequence of images taken from video footage showing ferrofluid's movements around circular magnetic features. This process, described in FIG. 1, is an experimental demonstration of ferrofluid micro-mixers and microfluidic controllers.
Figure 5:
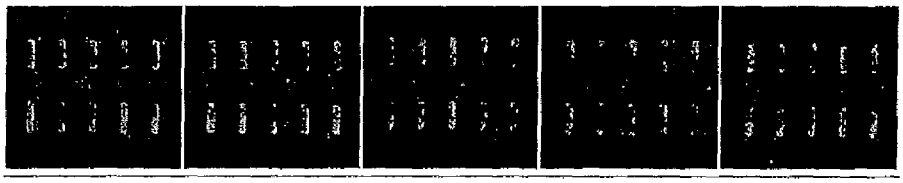
FIG. 5 is a sequence of images taken from video footage showing ferrofluid's movement across an array of rectangular magnetic features. This process, as described in FIG. 2, begins with ferrofluid accumulating in between adjacent magnetic features, and after one complete rotation in the external magnetic field, the ferrofluid aggregates move across one magnetic feature to the next.
Figure 6:
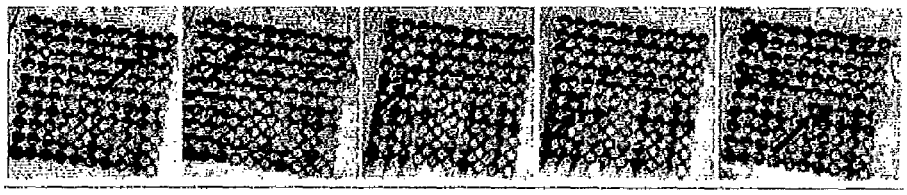
FIG. 6 is a sequence of images taken from video footage, which depicts the movement of a 7-micron non-magnetic bead manipulated by the surface of magnetic features and external rotating magnetic field. The magnetic field rotation is oriented like that shown in FIG. 5, with the bead originally positioned in the upper right-hand corner of the array. Through the sequence, the bead proceeds left to the upper left-hand corner, after which the axis of field rotation is rotated 90°, and then the bead proceeds down to the lower left-hand corner. The axis of field rotation is rotated another 90°, causing the bead to proceed right to the lower right-hand corner of the array. In the process, the trajectories of both magnetic and non-magnetic particles can be controlled to a great extent. In this scenario the axis of field rotation must be re-directed to cause the particle to turn. However, in a preferred embodiment, the magnetization pattern in the array of magnetic features can be re-programmed to cause non-magnetic particles to turn in chosen directions using only a single constant source of rotating magnetic field.

Results from experiments relating to the manipulation of ferrofluid and suspended non-magnetic particles near a substrate with magnetic features due to the application of a time-varying, substantially uniform magnetic field are shown in FIGS. 4, 5 and 6. FIG. 4 depicts a sequence of images, showing magnetic nanoparticles circulating around magnetic features, due to a uniform rotating magnetic field with its axis of field rotation aligned normal to the plane. The nanoparticles complete one revolution around the patterned magnetic features with each one half revolution of the external rotating field. In this image, the rotation was completed in less than one second, although significantly faster speeds can be achieved. FIG. 5 is a sequence of images taken from video footage, which depicts the linear progression of ferrofluid, like the process described in FIG. 2, across a series of magnetic features. The magnetic nanoparticles transverse a distance of one array period across the magnetic features (i.e. from one magnetic feature to the next) over the course of each complete revolution of the rotating magnetic field. FIG. 6 is a sequence of images taken from video footage, which depicts the movement of a single 7-micron non-magnetic bead manipulated by an array of magnetic features in highly defined directions across a substrate, similar to that described in FIG. 3. The sequence of images starts with the bead in the upper right-hand corner of the array. In the presence of a rotating magnetic field, the bead proceeds left to the upper left-hand corner, then down to the lower left-hand corner, and finally proceeds right to the right-hand corner of the array. In the process, precise trajectories of the particle are achieved using rotating magnetic fields as the mechanism for driving motion.

Programmable mixing of fluids near surfaces using a suspension of magnetic particles in accordance with the present invention is heavily facilitated by the ability to record the magnetization of selected magnetic features on the substrate in appropriate directions. In the case of circulating magnetic particles around patterned magnetic features of a substrate for application in mixing, recording the magnetization of individual magnetic features is not required. However, in order to move particles in a continuously linear direction across many magnetic features, the patterned magnetic features must be permanent (i.e. they must be able to retain their magnetized state in the presence of opposing field bias). Otherwise, the magnetic and non-magnetic particles would simply jump back and forth between the magnetic features, rather than move in a constant forward progression. By magnetizing individual features in the substrate with a tangential component to the axis of the rotating field, the trajectories of individual non-magnetic particles can be efficiently controlled primarily by the substrate even under a single unchanging source of rotating magnetic field. This phenomenon may be used to assemble precise patterns of non-magnetic particles. A second set of non-magnetic particles can be sorted or assembled at different locations by re-magnetizing the magnetic features in different orientations and then pushing a second set of non-magnetic particles that are injected into the fluid into newly programmed arrangements. Re-magnetizing of the surface includes two steps. The first step is to magnetize the magnetic features of the substrate to direct non-magnetic particles away from the previously assembled locations. The second magnetizing step is magnetizing other magnetic features of the substrate in order to direct the new set of non-magnetic particles towards newly desired locations on the surface. By repeating this procedure for each set of particles, a heterogeneous pattern can be built up step by step.

Mixing and assembling structures with magnetic substrate features and magnetizable fluids in accordance with the present invention provides significant advantages over other mixing techniques. For example, one advantage is that magnetic particles of the fluid automatically align with the recordable magnetic pattern on the substrate. This self-alignment provides an efficient way to assemble massive numbers of stirring rods in parallel using only a single source of external rotating magnetic field. Using a recordable magnetic pattern, the magnetic particle stirring rods can be programmed to push fluid and non-magnetic particles in the fluid into adjacent channels, against walls, and into other mechanical confines. It is also expected that the magnetic features can push the non-magnetic particles towards regions of the surface where they interact with the substrate by strong short-range affinity (i.e. accomplished through favorable surface tension, or direct chemical binding forces). These two locking schemes are suggested as mechanisms for freezing the assembled non-magnetic particle patterns in place once the desired configuration is achieved. As will be understood by one of skill in the art upon reading this disclosure, alternative locking mechanisms which do not substantially changing the scope of this invention can also be developed. Several different particles can be easily arranged by this process using only benign forces, since magnetic fields are biocompatible and do not significantly alter delicate biological materials. It is expected that heterogeneous patterns with resolution of 100 nm or better can be achieved using this technique. Traditional lithographic fabrication techniques, by contrast, have difficulty in aligning multiple patterns with micrometer resolution.

Another advantage of these devices is that the suspension of magnetic particles has been shown to perform consistent aggregation on the surface even when the magnetic features are separated from the fluid by barriers micrometers in thickness. The accumulation of magnetic particles at long range indicates that stirring can also be achieved using magnetic features embedded in a uniform passivating layer. Use of magnetic features embedded in the substrate allows non-magnetic particles to be manipulated and forced to interact with a surface that has uniform surface chemistry, which is essential for applications in combinatorial material synthesis, genomic analysis, drug discovery, cellular system fabrication, sensor and other applications. Magnetic particles can be coated with biocompatible agents or can be modified to be compatible with the non-magnetic particles of interest, such as different molecules, proteins, colloidal particles or cells that need to be manipulated near a surface. Since no harmful chemical solvents are employed, the magnetic particle stirring rods may provide a lithographic patterning tool specifically designed for assembling delicate biological materials without altering, damaging or destroying previously deposited materials.

The efficacy of this manipulation method was demonstrated using thin patterned Cobalt film. Recordable magnetic patterns were made in evaporated Cobalt film 100-nm in thickness by conventional photolithographic lift-off methods, as described Yellen et al. (J. Appl. Phys. 2003 93(10):7331). The magnetic patterns used in these experiments were circles with 5-microns diameter or rectangles with planar dimensions of 4-microns wide by 20-microns long. Following creation of a substrate containing magnetic features, the substrate was submersed in a bath of deionized water and an aqueous solution of domain-detection ferrofluid (purchased from Ferrotec, Inc., NH, USA) was injected into the bath under the influence of applied magnetic fields.

The circular motion of ferrofluid around a particular magnetic feature was demonstrated by rotating external magnetic fields with the axis of field rotation aligned normal to the substrate. Images taken from video footage confirm the ferrofluid movement around the magnetic features. The first image showed the ferrofluid extending from the ends of the magnetic features due to external magnetic fields being directed along the same line as the magnetization of the feature on the substrate. After rotating the field clockwise, the ferrofluid aggregates rotated around the magnetic feature in sync with the external fields.

The linear motion of ferrofluid across the substrate containing an array of magnetic features was demonstrated by applying external rotating magnetic field with axis of field rotation aligned parallel to the substrate and orthogonal to the magnetization of the magnetic features. Images taken from video footage confirm the linear movement of ferrofluid in the presence of this rotating external magnetic field bias. The ferrofluid initially was situated in between adjacent magnetic features due to magnetic field aligned parallel to the features' magnetization. When the external fields were rotated 90°, the ferrofluid moved from in between adjacent features to one of the feature's poles. When the external fields were rotated another 90°, the ferrofluid accumulated on top of the magnetic features due to a magnetic field bias that opposes the features' magnetization. After the external fields were rotated 90° once more, the ferrofluid accumulated at the other end of the magnetic features. Many such revolutions cause the ferrofluid to continually move across the substrate, in the process covering the distance of one array period across the magnetic features with each revolution of the external magnetic field. Complete switching of the ferrofluid from one side to the other was accomplished in under milliseconds, indicating that the ferrofluid can be moved at great speeds.

In addition to the above experiments, the process of magnetic particle fluid assembly of non-magnetic particles onto magnetized film was studied theoretically to determine the extent to which a fluid containing a dispersion of magnetic particles such as a ferrofluid can accumulate at programmed sites on a surface. In stabilized magnetic colloids, where spontaneous magnetization does not occur in the absence of magnetic field, equilibrium regions of particle aggregation are the result of competition between diffusion and magnetic forces. In many previous models in the literature, magnetic forces on particles were calculated using the assumption that the non-magnetic carrier fluid is incapable of screening external magnetic fields. This assumption is valid only in the regions of relatively low particle concentrations. Moreover, previous models of High Gradient Magnetic Separation schemes (HGMS) ignored possible perturbation of the external magnetic fields by the spatially varying concentration of the magnetic particles in the fluid. Volume susceptibility of the fluid at higher magnetic particle concentrations can be as high as 10. Thus, neglecting the demagnetizing field due to the spatially varying concentration is justified only at lower concentrations far away from any magnetic wires or magnetic poles placed in the fluid. The self-consistent model presented below takes into account both the magnetic field screening by the fluid and the demagnetizing field due to spatially varying particle concentration.

Volume magnetization, $M_p$, of a particle is dependent on external magnetic field H (which is assumed to be uniform inside the particle). For relatively weak magnetic fields, the relationship between the magnetization and magnetic field is linear and in the vector form can be written as follows:

$$\vec{M}_p = \chi\vec{H},\ \vec{m}_p = V_p\vec{M}_p,\ \chi = \frac{\mu_0 V_p M_s^2}{3k_B T} \tag{1}$$

where $m_p$ is the magnetic moment of a particle of volume $V_p$, $M_s$ is saturation magnetization of particles, $k_B$ is Boltzmann constant, and T is the absolute temperature.

The force acting on a particle inside magnetic fluid takes the form:

$$\vec{F}_m = \mu_0(\vec{m}_p - \langle\vec{m}\rangle)\cdot\nabla\vec{H} \tag{2}$$

where $\langle\vec{m}\rangle$ represents an average magnetic moment of unit volume of magnetic fluid surrounding the particle. We assume that $\langle\vec{m}\rangle$ at a given point in space is related to $m_p$ by:

$$\langle\vec{m}\rangle = \vec{m}_p C(\vec{r}) \tag{3}$$

where $C(\vec{r})$ is the volume concentration of particles (fraction of volume occupied by the particle material). The balance of force $\vec{F}_m$ on the magnetic particle and the fluid drag determines the velocity of particle (Stoke's law)

$$\vec{v}_p = \eta\vec{F}_m = \eta\mu_0(\vec{m}_p - \langle\vec{m}\rangle)\cdot\nabla\vec{H} \tag{4}$$

where the coefficient of proportionality $\eta$ is the mobility of the particle, which characterizes the fluid drag. The effects of magnetic field screening due to the fluid magnetization are taken into account in (2) and (4) by subtracting the average fluid magnetization. This is one of the main differences with respect to previous models employed in HGMS.

The total flux of particles is the sum of two components, a diffusion component $$\vec{J}_{diff} = -D\nabla C(\vec{r}) \tag{5}$$

and a drift component $$\vec{J}_{drift} = C(\vec{r})\vec{v}_p \tag{6}$$

Under static equilibrium conditions the total flux of particles must be zero, $$\vec{J} = \vec{J}_{diff} + \vec{J}_{drift} = 0. \tag{7}$$

Using (3-7) one obtains $$\nabla C(\vec{r}) = (k_B T)^{-1} C(\vec{r})(1 - C(\vec{r}))\mu_0\vec{m}_p\cdot\nabla\vec{H} \tag{8}$$

where, from the Einstein relation, $(k_B T)^{-1}=\eta/D$, and C is the unknown concentration of magnetic particles. Substituting $m_p$ defined in (1), equation (8) can be directly re-arranged as follows:

$$\frac{\nabla C(\vec{r})}{C(\vec{r})(1-C(\vec{r}))} = \nabla \ln\frac{C}{1-C} = \nabla\frac{\mu_0\chi V_p H^2}{2k_B T} \tag{9a}$$

Given that the bulk of the fluid is in zero field (far away from any field sources) and has bulk particle concentration $C_i$, equation (9a) can be easily integrated to yield:

$$\frac{C(\vec{r})}{(1-C(\vec{r}))} = \frac{C_i}{(1-C_i)}\exp\left(\frac{\mu_0\chi V_p H^2}{2k_B T}\right) = A\exp\left(\frac{\alpha^2}{6}\right) \tag{9b}$$

where the constant A and function $$\alpha(\vec{r}) = \frac{\mu_0 V_p M_s}{k_B T} H(\vec{r})$$

are dimensionless quantities defined for the sake of convenience. Expression for concentration can be obtained from (9b) by simple algebraic manipulation:

$$C(\vec{r}) = \frac{1}{1+A^{-1}\exp(-\alpha^2/6)}, \tag{10}$$

It is important to note that the dimensionless function $\alpha$ can be interpreted as the ratio of two energies: the particle's potential energy in the external magnetic field and its thermal fluctuation energy. From this, it is clear that spatial variation of concentration in (10) is completely consistent with equilibrium statistical mechanics. In fact, the right hand side of (10) can be recognized as the Fermi-Dirac function. It emerges as a result of field screening by magnetic particles in the solution, which reduces the magnetic force to zero at 100% concentration. In the presence of diffusion this does not allow particles to overlap. The impossibility of particle overlap leads to Fermi-Dirac distribution in much the same way as it happens due to the exclusion principle in Quantum Mechanics. Therefore, concentration saturation emerges naturally in this model without the need to use artificially set hard concentration limits often imposed in HGMS models that do not take field screening into account.

In determining average magnetization of the fluid the effects of particle interactions were neglected above. Mean Spherical model takes into account interactions between the particles by introducing a correction to the non-interacting particle model discussed above, which can be written in the linear regime of weak magnetic field as:

$$\langle\vec{m}\rangle=(1+\alpha C(\vec{r}))C(\vec{r})\vec{m}_p=(1+\alpha C(\vec{r}))C(\vec{r})V_p\chi\vec{H} \tag{11}$$

where $\chi$ is zero-field susceptibility defined through (1), and parameter a typically has value around 3, making the effects of concentration important when the concentration is greater than roughly 20-30%.

Using equation (4-7) and (11) and following the line of reasoning used to derive (9a), one finds:

$$\frac{\nabla C}{C(1-C)(1+aC)} = \nabla\left(\frac{\mu_0 V_p\chi H^2}{2k_B T}\right) = \nabla\frac{\alpha^2}{6} \tag{12}$$

Just like (9a), the above equation can be integrated to yield:

$$\frac{C(\vec{r})}{(1-C(\vec{r}))^{1/1+a}(1+aC(\vec{r}))^{a/1+a}} = A_{MS}\exp\left(\frac{\mu_0 V_p\chi H^2}{2k_B T}\right) = A_{MS}\exp(\alpha^2/6), \tag{13}$$

where the function $\alpha$ is defined as in (9b) and $$A_{MS} = \frac{C_i}{(1-C_i)^{1/1+a}(1+aC_i)^{a/1+a}}$$

is the integration constant evaluated, as before, by setting the field equal to zero and using the bulk fluid value of the concentration $C_i$.

Non-magnetic particles dispersed inside the magnetic fluid will experience a body force in the opposite direction as the magnetic particles, according to (4). The non-magnetic particles follow the regions of magnetic field minima, whereas the magnetic particles follow the regions of magnetic field maxima. Through changes in the external field or in the magnetization of the magnetic features on the surface, the non-magnetic particles can be moved across a surface, or can be arranged onto precise configurations of the surface. Accordingly, this indicates that magnetic nanoparticle suspensions such as ferrofluid can be used as to mix fluids and programmably manipulate non-magnetic particles inside the fluid.

The following nonlimiting example is provided to further illustrate the present invention.

EXAMPLES

Example 1

Materials and Methods

Experiments were performed using Silicon or Pyrex substrates patterned with 100 nm thick Cobalt film by conventional photolithographic lift-off process. In the lift-off process, an image is defined by exposing photoresist to ultraviolet radiation through a patterned optical mask. The photoresist pattern is developed, and then Cobalt is evaporated onto the patterned wafer. Finally, the remaining photoresist is stripped to produce a pattern of Cobalt film. While negative or multi-layer resists are frequently utilized to obtain an undercut resist profile, positive Shipley 1813 photoresist yielded satisfactory results. The magnetic features on the substrate consist of individual circular shapes with 5 μm diameter or rectangular shapes having a planar dimension of 4 μm wide by 20 μm long. Aqueous based ferrofluid domain detection fluid purchased from Ferrotec was applied to the substrate in varying concentrations. Aqueous based non-magnetic colloidal particles were added to the ferrofluid. A rotating magnetic field was applied to the substrate, which caused the ferrofluid particles as well as colloidal particles in the vicinity of the substrate to be manipulated in desired directions.

What is claimed is:

1. A method for manipulating non-magnetic particles dispersed inside a fluid comprising:

adding a fluid comprising magnetic particles and non-magnetic particles to a fluid holding chamber, wherein at least one of said non-magnetic particles is not attached to said magnetic particles;

creating a changeable pattern of magnetic field minima and maxima regions inside of said fluid holding chamber by applying a magnetic field via at least two sources of magnetic fields positioned in close proximity to, or inside of, said fluid holding chamber;

wherein said non-magnetic particles are transported towards the magnetic field minima regions by magnetic force; and wherein at least one of said sources of magnetic fields comprises an array of magnetizable features on a micrometer or nanometer length scale, and further wherein at least one of said sources of magnetic fields comprises a time-varying magnetic field supplied by a source held external to said fluid holding chamber.

2. The method of claim 1, wherein said fluid holding chamber comprises an inner surface and an outer surface.

3. The method of claim 2, wherein an array of different molecules is attached to the inner surface of the fluid holding chamber.

4. The method of claim 2, wherein an array of different nanoparticles or microparticles is attached to the inner surface of the fluid holding chamber.

5. The method of claim 2, wherein a sensor is attached to the inner surface of the fluid holding chamber.

6. The method of claim 5, wherein the sensor is selected from the group consisting of optical, electrical, electrochemical, and magnetic sensors.

7. The method of claim 1, wherein the magnetic particles dispersed in the fluid comprise magnetic nanoparticles, paramagnetic ions, or molecular magnets.

8. The method of claim 7, wherein the magnetic nanoparticles comprise iron, iron-oxide, iron-platinum, cobalt, nickel, a rare-earth metal or another alloy forming ferromagnetic, or a ferrimagnetic or superparamagnetic material, or any combination thereof.

9. The method of claim 7, wherein the magnetic nanoparticles have a surface covered by molecules which provide steric or ionic hinderance in order to prevent irreversible aggregation of the magnetic nanoparticles in the fluid.

10. The method of claim 1, wherein the magnetizable features are patterned on top of the inner surface of the fluid holding chamber.

11. The method of claim 1, wherein the magnetizable features are embedded inside of the inner surface of the fluid holding chamber.

12. The method of claim 1, wherein the magnetizable features are attached to mobile supports that can be submerged in the fluid.

13. The method of claim 1, wherein the patterns of the magnetizable field sources are changed by applying an additional time-varying source of substantially uniform magnetic field.

14. A method for sorting non-magnetic particles comprising:

(a) adding a fluid comprising magnetic particles to a fluid holding chamber, (b) adding a set of non-magnetic particles to said fluid holding chamber, wherein at least one of the non-magnetic particles in said set is not attached to said magnetic particles;

(c) creating a pattern of magnetic field minima and maxima regions inside of said fluid holding chamber by applying a magnetic field via at least two sources of magnetic fields positioned in close proximity to, or inside of, said fluid holding chamber, wherein at least one of said sources of magnetic fields comprises an array of magnetizable features on a micrometer or nanometer length scale, and further wherein at least one of said sources of magnetic fields comprises a time-varying magnetic field supplied by a source held external to said fluid holding chamber;

(d) transporting said set of non-magnetic particles to said magnetic field minima regions in said pattern by magnetic force; and (e) repeating steps (b) through (d) for at least one additional set of non-magnetic particles.

15. The method of claim 14, wherein said pattern of magnetic field minima and maxima regions inside said fluid holding chamber created in step (c) is substantially different for each set of non-magnetic particles, such that each set of non-magnetic particles is transported to a different region within said fluid holding chamber.

16. The method of claim 14, wherein said at least one additional set of non-magnetic particles is transported to said magnetic field minima regions without substantially altering non-magnetic particles transported in previous steps.

17. The method of claim 14, wherein said magnetic particles are removed from said fluid holding chamber after the desired number of non-magnetic particles have been sorted.

18. The method of claim 14, wherein a portion of said set of non-magnetic particles in step (d) is not transported to said magnetic field minima regions.

19. The method of claim 15, wherein said portion is substantially removed from said fluid holding chamber prior to adding said at least one additional set of non-magnetic particles in step (b).

* * * * *